US009731796B2

(12) United States Patent
Chiu et al.

(10) Patent No.: US 9,731,796 B2
(45) Date of Patent: Aug. 15, 2017

(54) WELL INTERVENTION SEMISUBMERSIBLE VESSEL

(71) Applicant: Helix Energy Solutions Group, Inc., Houston, TX (US)

(72) Inventors: Hin Chiu, Sugar Land, TX (US); Colin Johnston, Houston, TX (US)

(73) Assignee: Helix Energy Group Solutions, Inc., Houston, TX (US)

( * ) Notice: Subject to any disclaimer, the term of this patent is extended or adjusted under 35 U.S.C. 154(b) by 0 days.

(21) Appl. No.: 14/586,903

(22) Filed: Dec. 30, 2014

(65) Prior Publication Data

US 2015/0183495 A1 Jul. 2, 2015

Related U.S. Application Data

(60) Provisional application No. 61/922,441, filed on Dec. 31, 2013.

(51) Int. Cl.

| | |
|---|---|
| ***E21B 15/02*** | (2006.01) |
| ***E21B 19/00*** | (2006.01) |
| ***B63B 35/44*** | (2006.01) |
| ***E21B 15/00*** | (2006.01) |
| *B63B 3/14* | (2006.01) |

(52) U.S. Cl.

CPC ..... *B63B 35/4413* (2013.01); *E21B 15/003* (2013.01); *E21B 15/02* (2013.01); *B63B 2003/147* (2013.01)

(58) Field of Classification Search

CPC ..... E21B 7/128; E21B 15/02; E21B 15/003; E21B 19/002; B63B 35/44; B63B 35/4413

USPC ..... 175/7; 114/264; 166/352, 358; 405/195.1, 201

See application file for complete search history.

(56) References Cited

U.S. PATENT DOCUMENTS

| | | | | |
|---|---|---|---|---|
| 4,208,158 | A * | 6/1980 | Davies et al. | 414/22.68 |
| 4,617,998 | A | 10/1986 | Langner | |
| 6,766,860 | B2 * | 7/2004 | Archibald et al. | 166/341 |
| 6,932,553 | B1 * | 8/2005 | Roodenburg et al. | 414/22.51 |
| 6,988,459 | B2 * | 1/2006 | Roodenburg et al. | 114/268 |

(Continued)

FOREIGN PATENT DOCUMENTS

| | | |
|---|---|---|
| WO | 9932352 | 7/1999 |
| WO | WO 2013169099 A2 * | 11/2013 |

OTHER PUBLICATIONS

Rhee, PCT Search Report for PCT Application No. PCT/US14/72901 dated Apr. 9, 2015, pp. 3.

(Continued)

*Primary Examiner* — Matthew R Buck

(74) *Attorney, Agent, or Firm* — Locke Lord LLP

(57) ABSTRACT

A well intervention semisubmersible vessel and method including a drilling rig further including a non-elevated derrick floor and a handling tower having a single point land out without riser tensioners. The vessel may also include a flush drill floor, a flush moonpool door, a lift frame and personnel access walkway wherein the lift frame is capable of being skidded into position by a skidding system capable of providing personnel access and wherein the skidding system comprises a plurality of skidding rails, at least one remotely operated vehicle, an intervention rising system and storage area, a crane, a moonpool and handling area, a moonpool trolley, at least one fluid pump, and/or at least one tank.

16 Claims, 7 Drawing Sheets

(56) References Cited

U.S. PATENT DOCUMENTS

| | | | | |
|---|---|---|---|---|
| 8,079,426 | B2 * | 12/2011 | Petersson | 175/5 |
| 8,522,880 | B2 * | 9/2013 | Roodenburg et al. | 166/339 |
| 8,672,043 | B2 * | 3/2014 | Korach et al. | 166/385 |
| 8,678,094 | B2 * | 3/2014 | Banks | 166/352 |
| 8,733,472 | B2 * | 5/2014 | Magnuson | 175/7 |
| 2008/0267716 | A1 | 10/2008 | D'Souza | |
| 2009/0025937 | A1 * | 1/2009 | Robinson et al. | 166/351 |
| 2009/0272540 | A1 | 11/2009 | Rodgers | |
| 2010/0116507 | A1 * | 5/2010 | Haugland | 166/352 |
| 2010/0314121 | A1 * | 12/2010 | Sorenson | E21B 19/22 166/342 |
| 2012/0018166 | A1 * | 1/2012 | Croatto | 166/355 |
| 2012/0318530 | A1 * | 12/2012 | Wollum | E21B 19/22 166/379 |
| 2013/0075102 | A1 | 3/2013 | Dao | |
| 2014/0151057 | A1 * | 6/2014 | Wijning | E21B 19/006 166/352 |
| 2014/0231089 | A1 * | 8/2014 | Labrugere | 166/344 |
| 2015/0090464 | A1 * | 4/2015 | Johnston | E21B 19/002 166/385 |

OTHER PUBLICATIONS

Rhee, Written Opinion for PCT Application No. PCT/US14/72901 dated Apr. 9, 2015, pp. 7.

* cited by examiner

WELL INTERVENTION SEMISUBMERSIBLE VESSEL

CROSS REFERENCE TO RELATED APPLICATIONS

This nonprovisional application for patent claims priority to, and hereby incorporates by reference, U.S. Provisional Application Ser. No. 61/922,441, entitled "Well Intervention Semisubmersible Vessel," filed Dec. 31, 2013.

BACKGROUND OF THE INVENTION

Technical Field of Invention

The invention disclosed and taught herein relates generally to a system and method for use in floating offshore environments including drilling rigs. The embodiments described below related generally to the design layout of equipment on an offshore Well Intervention Semisubmersible (WIS) platform specifically for the transport, deployment, and retrieval of well intervention subsea equipment.

Background of the Invention

A typical layout of an exploratory drilling rig is to place a pyramid type drilling derrick at or near the center of the upper deck with an "elevated drill floor." These type of derricks are usually built of truss structures with the drilling equipment installed within its footprint boundary. A drilling riser would be installed through the rotary table on the drill floor and connected to the subsea well. It is essentially a conduit for running the drill string to the well below and allowing the return of mud flow through the riser annulus to the surface. At the bottom of the drilling riser, there is a safety device called the subsea BOP Stack (Blow Out Preventer) latched on the wellhead and the LMRP (Lower Marine Riser Package). The BOP stack is designed to have the mechanism to shear off the drill string and shut in the well for well control purpose. Whereas the LMRP provides the quick disconnect mechanism of the riser on the top of the BOP in the event the drilling vessel is required to move away from the well that is out of control. The typical size of a deep water drilling riser joint has about a 21 inch outer diameter, about 75 feet in length, and with over about 50 inch of diameter for the buoyancy material attached. For deep water application, the combined BOP stack and LMRP can reach over 60 feet tall and the combined weight over 400 metric tonnes depending on the number of rams being configured on the BOP. Accordingly, the equipment for assembling, handling, transporting, and positioning the massive BOP stack and the LMRP underneath the drill floor becomes the center issue in the drilling system design layout. In order to provide sufficient head room for this operation, an elevated drill floor is normally required in the layout. Such an elevated drill floor is supported by the derrick substructures on the upper deck.

The design of a Well Intervention Semisubmersible, however, is not intended for drilling of a new well to the reservoir formation. Instead, its primary function is to provide down hole work-over service of a well that has been produced for a period of time. A typical well intervention operation can be performed by means of different methods including slick line, wire line, and coiled tubing deployment through the riser. The corresponding well intervention riser has a smaller diameter in comparison with a drilling riser, usually in the range of 7 to about 8.5 inch outer diameter. Unlike the drilling of an exploratory or development well, the physical characteristics of the well and the composition of the well stream are usually known prior to the well intervention operation. The use of a full size drilling BOP stack and LMRP is considered as overkill for well intervention. Therefore a need exists to provide for a vessel with a non-elevated derrick.

SUMMARY OF THE INVENTION

A well intervention semisubmersible vessel and method including a drilling rig further including a non-elevated derrick floor and a handling tower having a single point land out without riser tensioners. The vessel may also include a flush drill floor, a flush moonpool door, a lift frame and personnel access walkway wherein the lift frame is capable of being skidded into position by a skidding system capable of providing personnel access and wherein the skidding system comprises a plurality of skidding rails, at least one remotely operated vehicle, an intervention rising system and storage area, a crane, a moonpool and handling area, a moonpool trolley, at least one fluid pump, and/or at least one tank.

Marine riser based semi-submersible operations traditionally involve a drilling rig with a drill floor derrick substructure. This arrangement works well for drilling operations since the focus is on pipe handling efficiency. A preferred method for well intervention includes operating a flat flush deck semi-submersible without a drill floor derrick substructure. This approach enables the user to handle pipe like a drilling rig but also to handle the subsea equipment and the surface well service equipment more efficiently than a rig. One advantage of this approach is the ability to rig equipment up and rig equipment down quickly when intervening on a well. A drilling rig is on a well for months at a time so pipe handling efficiency is important whereas intervention operations take on average 10 to 15 days so equipment and pipe handling is the key to efficient operations.

The combination of flat deck, i.e. no derrick substructure, and open derrick structure combined with heavy lift crane capability provides a unique operating aspect to normal semi-submersible operations for subsea well intervention work. The user is able to accommodate the heavy equipment associated with subsea well intervention operations (subsea trees and manifolds and surface coiled tubing reels and lift frames). The flat, flush and open deck design permits ease of movement of equipment, compared to traditional semi-submersibles, and the heavy lift capability enables large equipment handling with ease compared to limited capability drilling semi-submersibles.

The handling capabilities based around the use of the flat, flush and open deck design further enhances well intervention operations through elimination of the riser tensioners for use with the intervention riser system when operations allow. Eliminating the use of riser tensioners increases the efficiency with which equipment rig up, handling, deployment, and rig down is accomplished. During operations with the intervention riser system attached to the well riser tension is accomplished via a single point land out through maintaining the riser tension from the derrick structure. The combination of passive heave compensation to limit the vessel motion being imparted to the intervention riser system and the active heave compensation in line with the passive heave compensation provides the operational redundancy required during single point land out operations and eliminates the requirement for riser tensioners as an operating mode option.

An additional feature is the ability to rig up, handle, and deploy and rig down well service equipment covering pressure control equipment, coiled tubing equipment and electric line and slick line. A self-standing skidding lift frame of box construction enables access to the well service equipment once rigged up over the well. Personnel access is granted via a walkway that eliminates the relative motion of the vessel to the riser. Unlike existing lift frame designs this is intended to promote safe working at height with flexibility of self-standing equipment to assist with rig up.

Unlike dual derricks, this allows the user to hang off a string of pipe within the moonpool to assist with such operations as top hole drilling and also well abandonment. Using a single derrick and a flat deck vessel the moonpool is designed large enough to accommodate two hanging strings of pipe, one active and one passive. This limits the amount of round trip operations required for well intervention work.

DESCRIPTION OF THE DISCLOSED EMBODIMENTS

Figure 1:
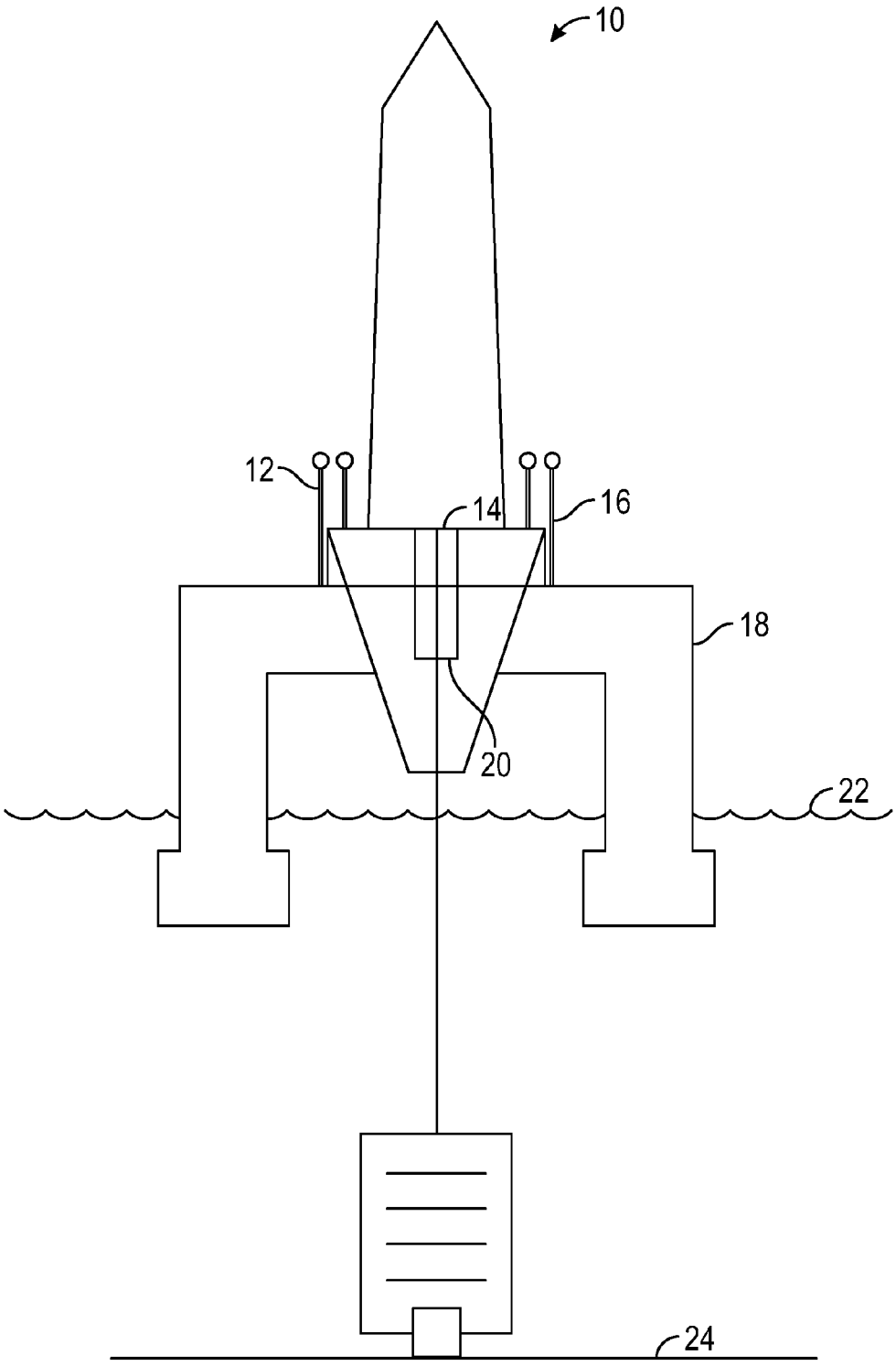
FIG. 1 (Prior Art)
FIG. 1 shows a side view diagram of an embodiment of a typical generic semi-submersible drilling rig having an elevated derrick floor.

The drawings described above and the written description of specific structures and functions below are presented for illustrative purposes and not to limit the scope of what has been invented or the scope of the appended claims. Nor are the drawings drawn to any particular scale or fabrication standards, or intended to serve as blueprints, manufacturing parts list, or the like. Rather, the drawings and written description are provided to teach any person skilled in the art to make and use the inventions for which patent protection is sought. Those skilled in the art will appreciate that not all features of a commercial embodiment of the inventions are described or shown for the sake of clarity and understanding.

Persons of skill in this art will also appreciate that the development of an actual, real-world commercial embodiment incorporating aspects of the inventions will require numerous implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention or the appended claims.

A semisubmersible platform is designed to include a lower hull and an upper hull. The lower hull consists of a plural number of submerged pontoons and a plural number of sea surface piercing columns. The functional requirements of the lower hull are preferable to provide the proper buoyancy and structural integrity for supporting the whole unit, and to provide the space for the machinery such as thruster rooms, pump rooms, etc., and liquid storage for ballast water, fresh water, fuel, and oil field related liquids.

The draft, dimensions, and geometry of the lower hull determine the motion characteristics of the unit in waves. Moreover, the position and cross sectional area of the surface piercing column members together with the vertical center of gravity of the unit determine the stability of the unit.

The upper hull may include a single or multiple decks and is designed to be placed on top of the columns to provide the space for accommodation, machinery, consumables, and the working areas of the crew. The space between the deck bottom and the mean water line of the vessel is known as the air gap. The air gap is designed to provide the clearance of the waves from reaching the deck level.

In general, the semisubmersible platforms for offshore oil and gas operation can be described in five different subcategories based on their primary functional requirements, namely: to perform exploratory drilling and well construction; to perform well intervention operation; to perform subsea installation and construction operations; to produce oil and gas; and to provide accommodation living quarters.

The equipment layout of the design is determined by the mission and hence the functional requirements of the unit in question. An optimum design layout for a specific rig category may not be applicable to the other categories at all. For example, if a drilling semisubmersible in category one is used to perform well intervention operation, its operating efficiency may suffer due to its inherent equipment arrangement on the deck and the associated deployment procedure of subsea equipment to the sea floor. Conversion of a drilling rig to a well intervention rig would lead to similar restrictions in operation.

In the present invention, a purposed design of subsea valve blocks also known as the Intervention Riser System (IRS) together with and including a lower riser package composed of valves to close in the well and an emergency disconnect package (EDP) to enable disconnection and release of the IRS and therefore vessel from the well would be used to achieve the emergency shut in capability for the well and optimum working efficiency for deployment and retrieval of the equipment. The dimensional size of the IRS is substantially smaller and its weight is about ¼ to about ⅓ of a BOP stack. Because of the reduction of equipment size and weight, the optimum layout of a well intervention semisubmersible has a revolutionary change of the deck layout which leads to a substantial improvement of the operating efficiency in terms of assembly, handling, deployment and retrieval of subsea equipment such as the IRS and riser system.

By using an open derrick, the new concept allows the time to rig up the well intervention equipment (i.e. slick line, wire line or coiled tubing) much faster than the use of a traditional enclosed drilling derrick. The design concept features an open derrick to be installed on a flat deck with a flush moonpool door replacing an elevated drill floor substructure which is normally found on a semisubmersible drilling rig.

In a preferred embodiment, the layout of the upper deck with the use of an open derrick and a mechanized driven flush moon pool door. This moon pool door preferably has dual functions: it features a false rotary table for running subsea equipment at the well center; and it can be used as a transporter for moving the IRS from its assemble location to the deployed position at the well center. With this arrangement, the initial rig up time and the time for running and retrieval time of the IRS and the riser to and from the sea floor can be greatly reduced. The total time for servicing a well become a fraction of that if it is performed on an exploratory drilling unit.

When a second operation is required for running subsea equipment on the vessel, the operating efficiency is further enhanced by introducing a moon pool trolley on the lower deck level. This moon pool trolley is a mechanized driven structure similar to the moon pool door that can be moved back and forth from a parked position to the well center. The moon pool trolley features a hang off mechanism for the supporting riser string with the IRS assembly in the water; thereby allowing the free up of the working space on the moon door above.

In the event a second set of subsea equipment such as the change out or removal of a subsea tree is required, the previous deployed riser string with the LMRP would be hung off on the moon pool trolley and get out of the way from the well center. This saves the time for running a round trip of the same riser and the IRS back to the surface. In deep water operation, it translates into a saving of multiple days of time.

FIG. 1 shows a side view diagram of a drilling rig 10. Riser tensioners 12 are shown next to the rotary table 14 on the derrick floor 16 of the main hull 18. The low pressure telescopic joint 20 passes through the main hull 18. As shown, the main hull 18 is floating on the surface 22 of the water with a lower marine riser package including a BOP stack and LMRP from the assembly position to the well center above the seafloor 24.

Figure 2:
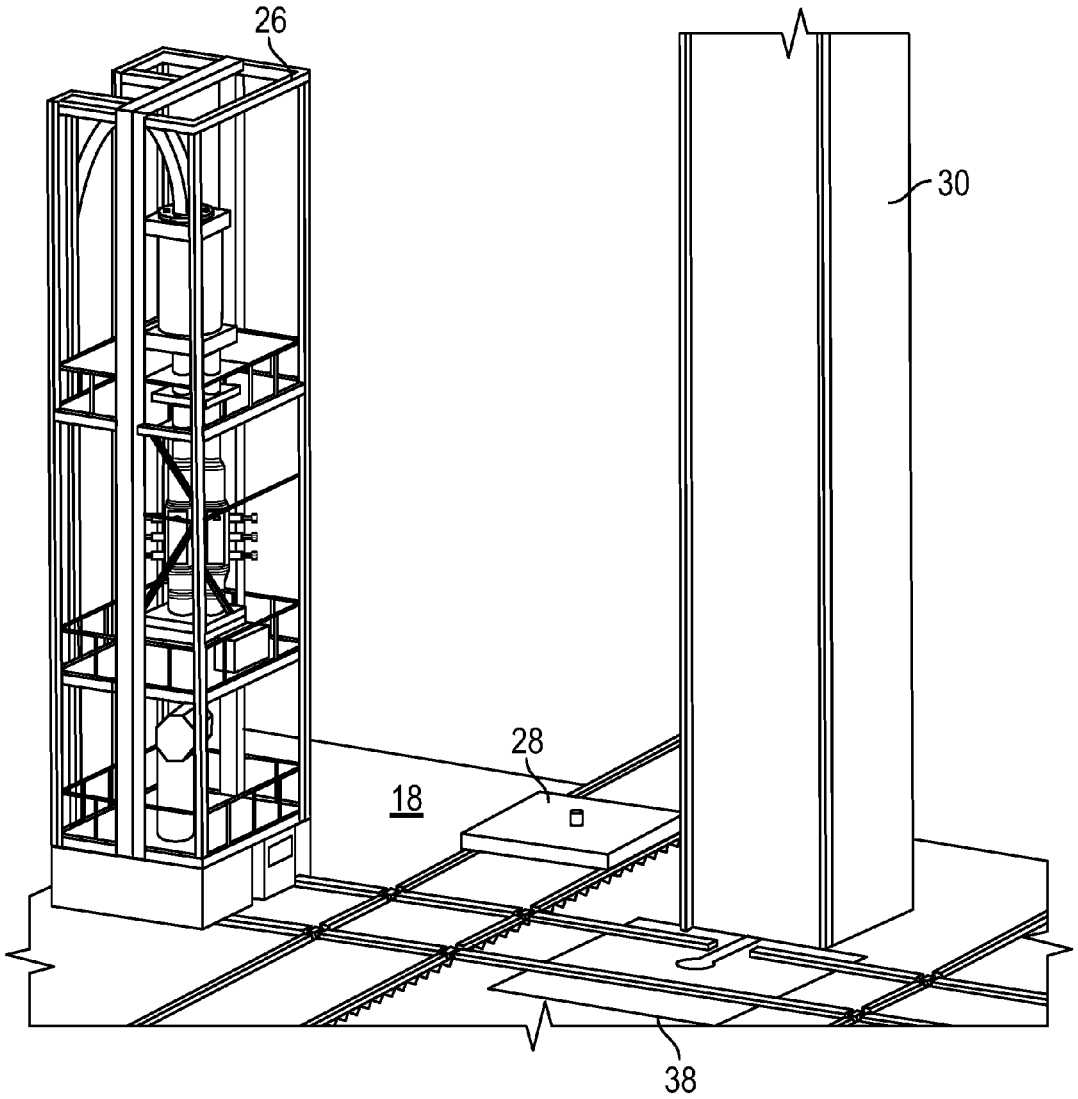
FIG. 2 shows a perspective view of an embodiment of a semisubmersible vessel of the present invention with a flat derrick floor.

As shown in FIG. 2, the rig may contain a lift frame and personnel access walkway 26 that may be skidded into position by a skidding system capable of provided personnel access 28 to the handling tower having a single point land out without riser tensioners ( ) 30. This embodiment eliminates the requirement for riser tensioners 12 and correspondingly the low pressure telescopic joint 20 by being able to have a single point landout from the handling tower 30. Additionally, no rotary table 14 is required, but the non-elevated derrick floor 16 of this embodiment is at the same level as the main hull 18. This allows for a flush drill floor and a flush moonpool door, which offers the advantage of being able to slide deck equipment into and out of the deployment capability of the handling tower 30.

Figure 3:
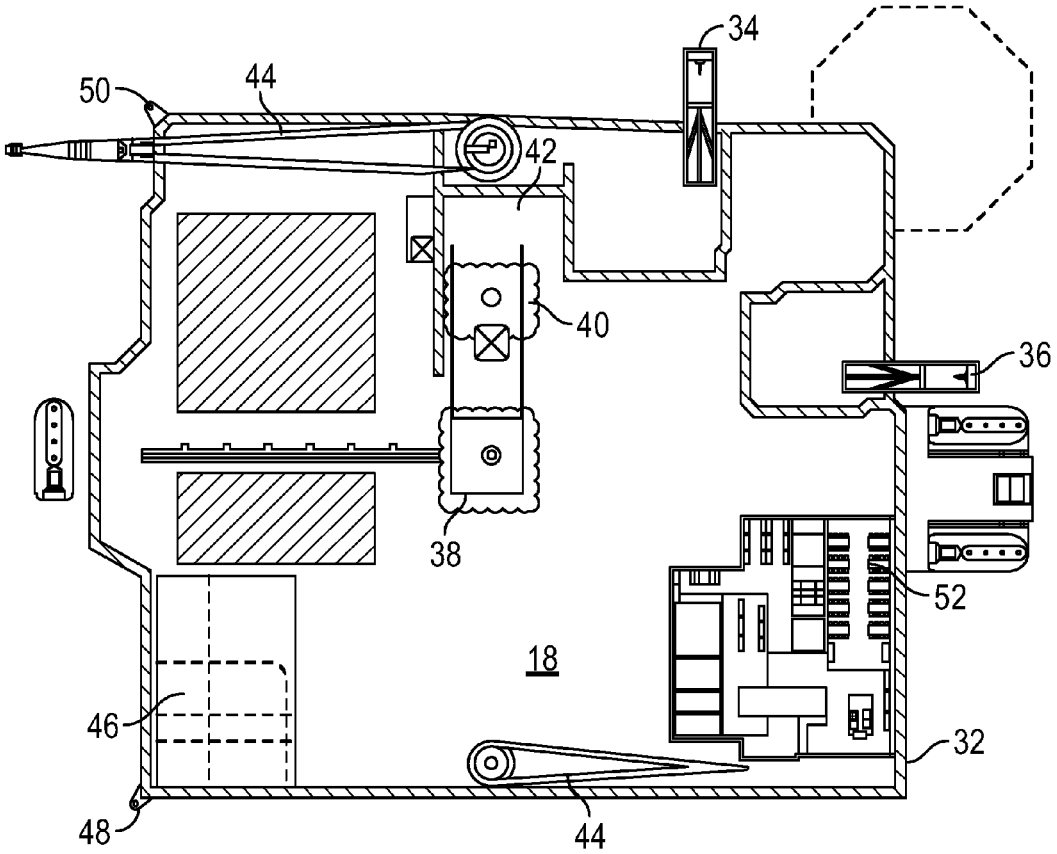
FIG. 3 shows an overhead plan view diagram of the upper deck layout of a well intervention semisubmersible vessel.

FIG. 3 shows an overhead plan view diagram of the upper deck layout 32 of a well intervention semisubmersible where the moon pool door 38 moves in transverse direction of the deck. The remotely operated vehicles 34 and 36 are also shown. The moonpool door 38 are shown in connection with the skidding rails 40. The intervention riser system and storage area 42 is also shown in connection with the skidding rails 40. Flat pipe deck lay down and handling area 42 and crane 44 is also shown. Well test area 46 and flare booms 48 and 50 are shown in FIG. 3 also. The rig also contains an accommodation area 52.

Figure 4:
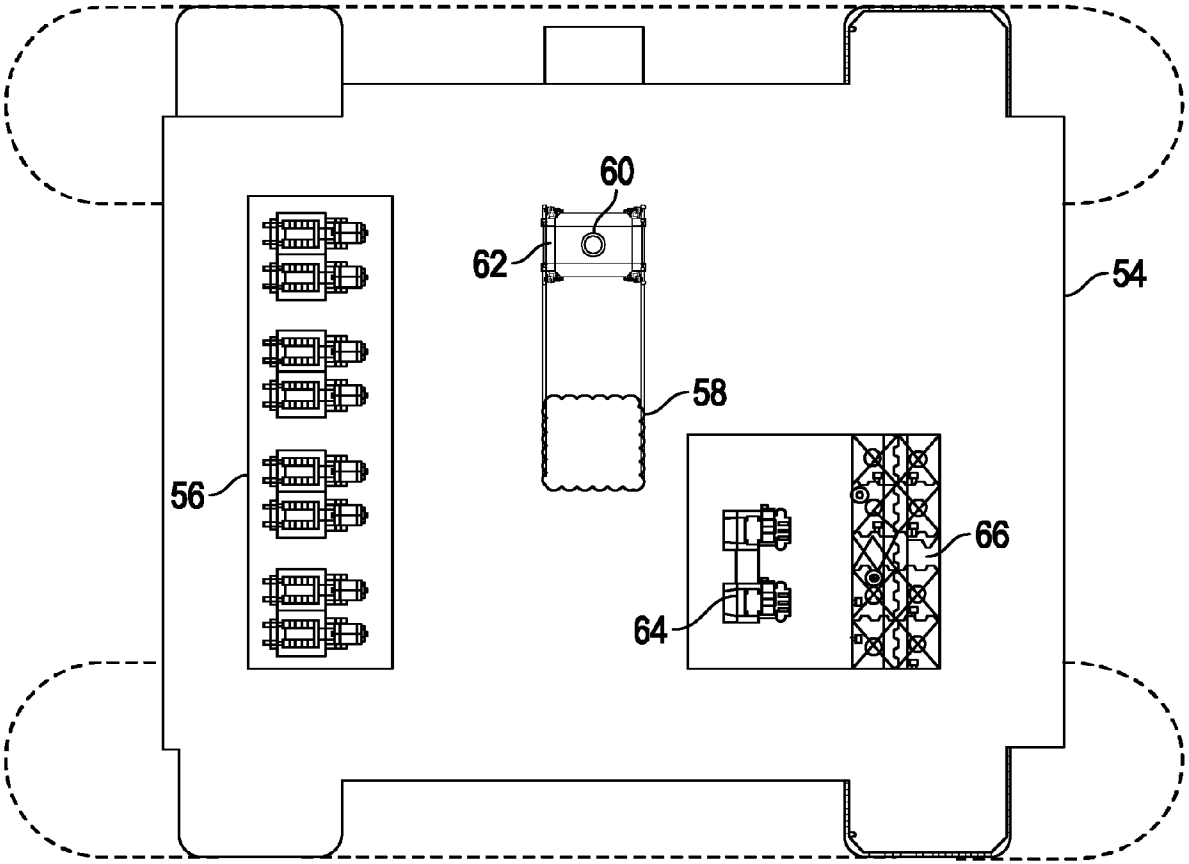
FIG. 4 shows an overhead plan view diagram of the lower deck layout of a well intervention semisubmersible vessel.

FIG. 4 shows an overhead plan view diagram of the lower deck layout of a well intervention semisubmersible perimeter with the moon pool trolley, located below the main working deck level 54, moves in transverse direction. The engine room and marine equipment area 56 is depicted in the well intervention main work level 54. The moonpool and handling area 58 includes a moonpool trolley 60 and skid rails 62. Fluid pumps 64 and tanks 66 are shown.

Figure 5:
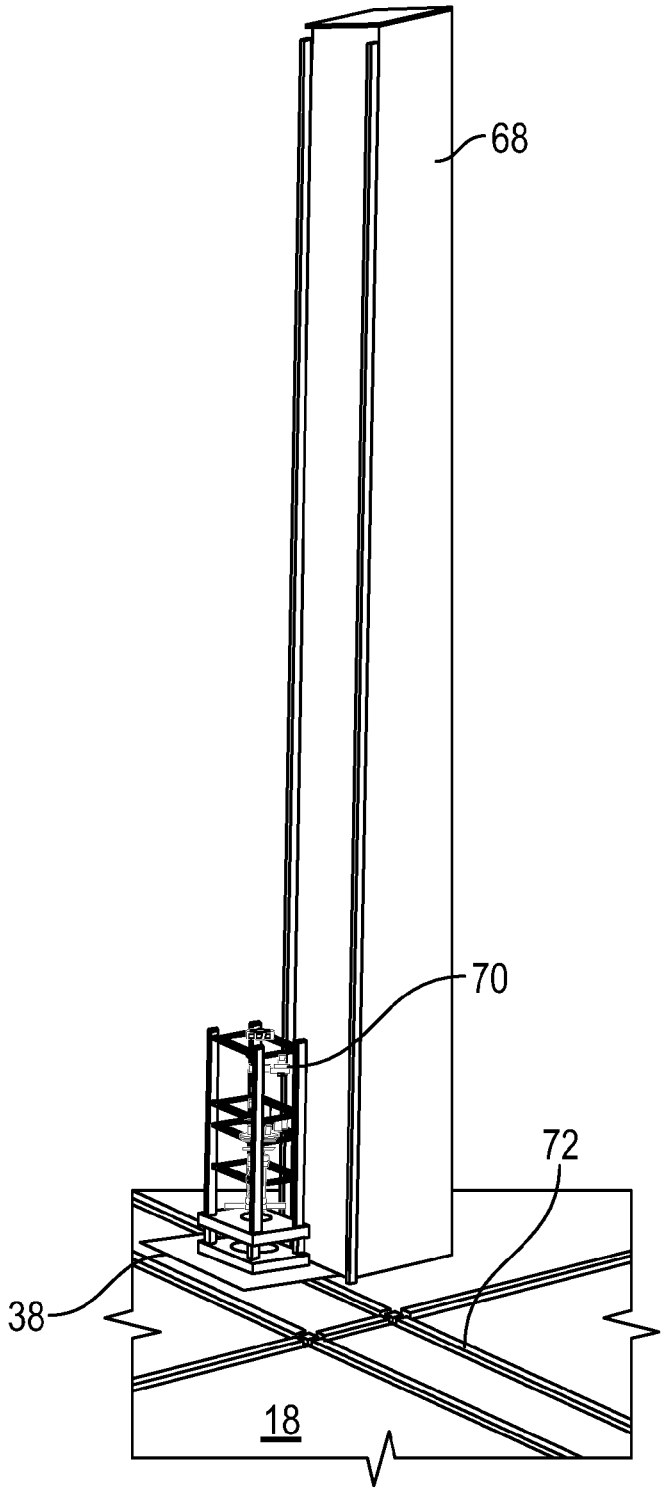
FIG. 5 shows a perspective view of an embodiment of a semisubmersible vessel of the present invention.

FIG. 5 shows a close up perspective view of the upper deck layout of a well intervention semisubmersible vessel. The handling tower 68 is shown with the intervention riser system 70 that can skid on the skid rails 72.

Figure 6:
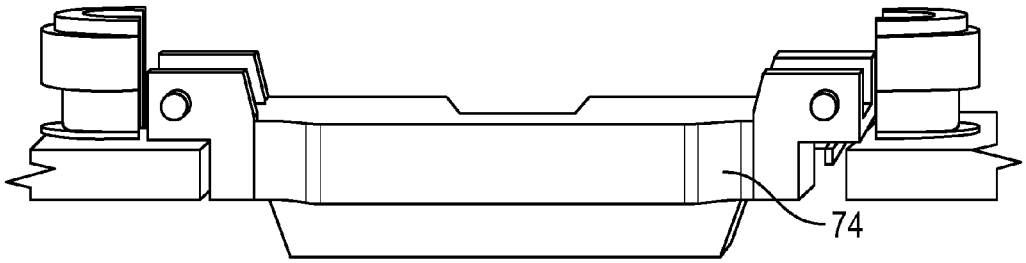
FIG. 6 shows a close up side view of the upper deck layout of a well intervention semisubmersible with the moon pool trolley moving in a longitudinal direction.
Figure 7:
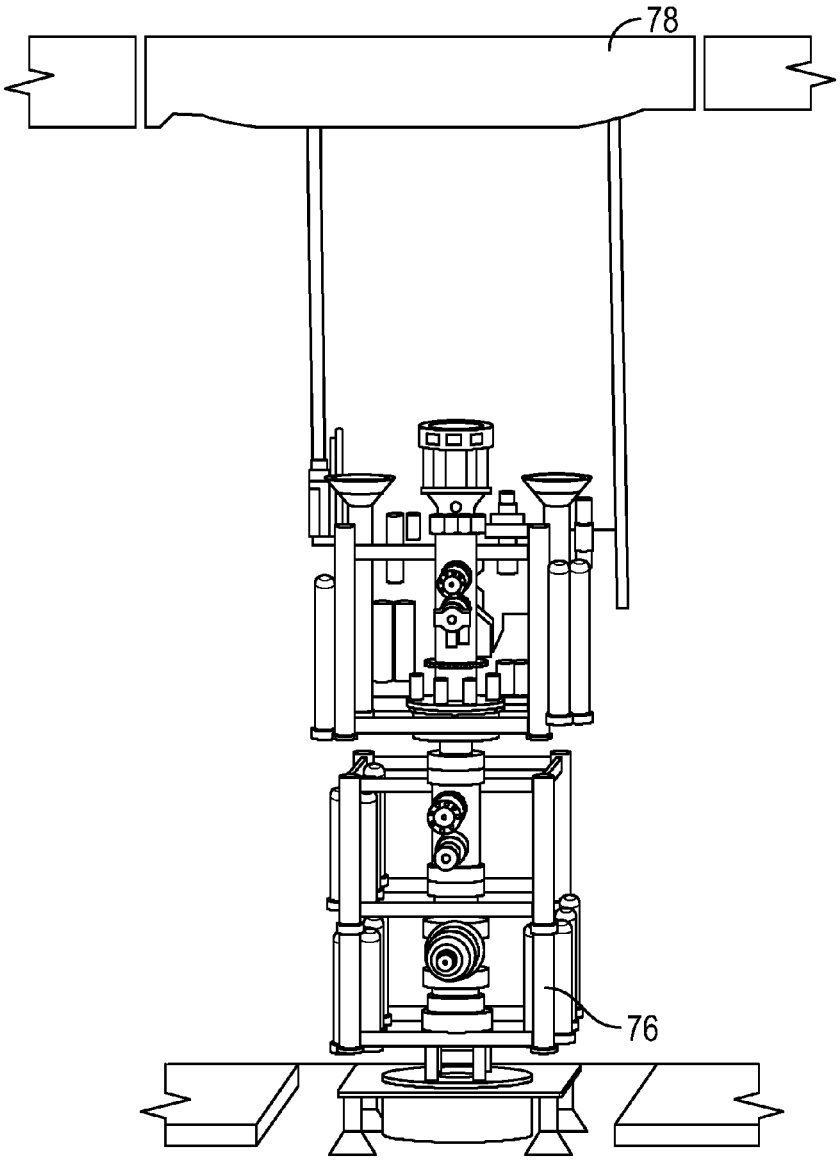
FIG. 7 is a close up side view of a hung off of riser and intervention riser system assembly on the moon pool trolley.

FIG. 6 shows a close up side view of the upper deck layout of a well intervention semisubmersible vessel with the moon pool trolley 74 moving in longitudinal direction. FIG. 7 is a close up side view that highlights the capability of hang off of equipment 76 at the moonpool trolley. The ability to skid out of the center line and continue operations from the moonpool door level 78.

Figure 8:
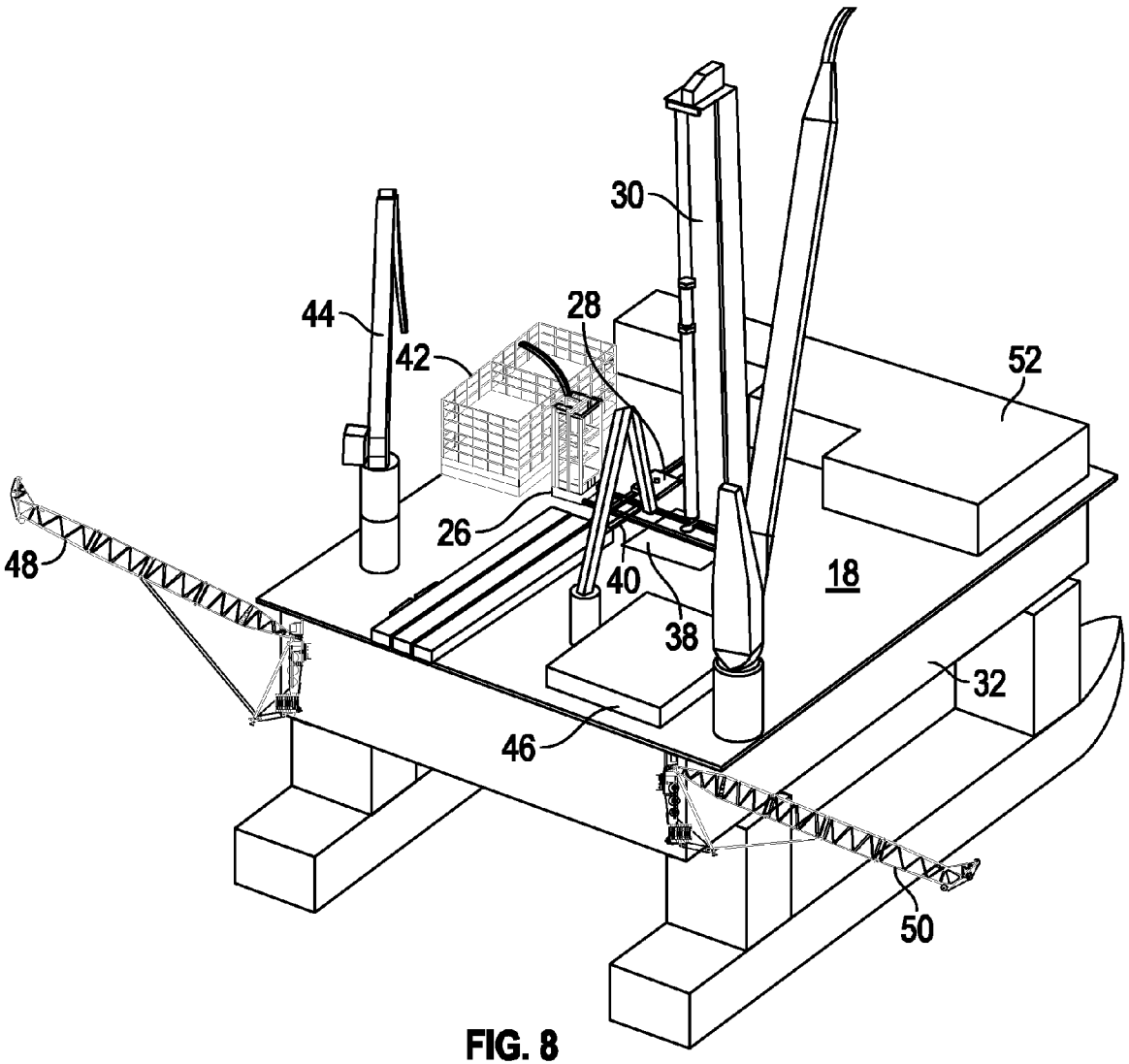
FIG. 8 shows a perspective view of a preferred embodiment of the well intervention semisubmersible.

FIG. 8 shows a perspective view of a preferred embodiment of the well intervention semisubmersible vessel showing the single point land out of the intervention riser system. As shown, the upper deck 32 of the vessel may contain the lift frame 26 that may skidded into position by a skidding system 28 to the handling tower 30. The skidding rails 40 are connected to the intervention rising system and storage area 42. Fluid deck lay down and handling area 42 and crane 44 is also shown. Well test area 46 and flare booms 48 and 50 are shown in FIG. 3 also. The rig also contains an accommodation area 52.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention.

The invention claimed is:

1. A well intervention semisubmersible vessel, wherein the vessel has a main hull level, comprising:

a drilling rig disposed on the main hull level, the drilling rig further comprising a derrick floor formed in the main hull level at the same level as the main hull level;

a handling tower disposed on the derrick floor, wherein the handling tower comprises a single point land out without riser tensioners;

a drill floor at the same level as the main hull level;

a moonpool door slidably connected to the derrick floor wherein the moonpool door is capable of being at the same level as the main hull level;

a skidding system positioned on the derrick floor; and a lift frame capable of being skidded into position on the skidding system to the handling tower.

2. The vessel of claim 1 further comprising a personnel access walkway.

3. The vessel of claim 1 wherein the skidding system comprises a plurality of skidding rails.

4. The vessel of claim 1 further comprising at least one remotely operated vehicle.

5. The vessel of claim 1 further comprising an intervention rising system and storage area.

6. The vessel of claim 1 further comprising a crane.

7. The vessel of claim 1 further comprising a moonpool and handling area.

8. The vessel of claim 1 further comprising a moonpool trolley.

9. The vessel of claim 1 further comprising at least one fluid pump and at least one tank.

10. A method of using a well intervention semisubmersible vessel, wherein the vessel has a main hull level and wherein the vessel comprises a drilling rig disposed on the main hull level, the drilling rig further comprising a derrick floor formed in the main hull level at the same level as the main hull level and a handling tower disposed on the derrick floor, wherein the handing tower comprises a single point land out without riser tensioners, a drill floor formed in or connected to the derrick floor, wherein the drill floor is at the same level as the main hull level, a moonpool door slidably connected to the derrick floor wherein the moonpool door is capable of being at the same level as the main hull level, a skidding system positioned on the derrick floor, and a lift frame capable of being skidded into position on the skidding system, the method which comprises the step of skidding the lift frame on the skidding system on the derrick floor to the handling tower.

11. The method of claim 10 wherein the skidding system comprises a plurality of skidding rails.

12. The method of claim 10 wherein the vessel further comprises at least one remotely operated vehicle.

13. The method of claim 10 wherein the vessel further comprises an intervention rising system and storage area.

14. The method of claim 10 wherein the vessel further comprises a moonpool and handling area.

15. The method of claim 10 wherein the vessel further comprises a moonpool trolley.

16. The method of claim 10 wherein the vessel further comprises at least one fluid pump and at least one tank.

* * * * *